United States Patent [19]

Knight et al.

[11] 4,430,043

[45] Feb. 7, 1984

[54] VARIABLE STATOR VANE OPERATING MECHANISM FOR TURBOMACHINES

[75] Inventors: Ronald W. Knight; Clive E. Olive, both of Bristol, England

[73] Assignee: Rolls-Royce Limited, London, England

[21] Appl. No.: 272,550

[22] Filed: Jun. 11, 1981

[30] Foreign Application Priority Data

Jun. 28, 1980 [GB] United Kingdom ..... 8021304

[51] Int. Cl.[3] ..... F01B 25/02

[52] U.S. Cl. ..... 415/159; 415/149 R

[58] Field of Search ..... 415/147, 149 R, 160, 415/159

[56] References Cited

U.S. PATENT DOCUMENTS 3,314,595 4/1967 Burge et al. ..... 415/160

3,719,427 3/1973 Davis ..... 415/160 X

FOREIGN PATENT DOCUMENTS 24868 3/1963 German Democratic Rep. ..... 415/160

167406 1/1965 U.S.S.R. ..... 415/160

*Primary Examiner*—Stephen Marcus

*Assistant Examiner*—Joseph M. Pitko

*Attorney, Agent, or Firm*—Parkhurst & Oliff

[57] ABSTRACT

A variable stator vane operating mechanism for a gas turbine engine includes a plurality of unison rings 21,22 and 23 each connected by a drag link 18,19 and 20 respectively to a pivoting beam 14. The unison rings are connected to each of vanes 10 in a stator vane row by first arms 24. In order to minimize side loads on the unison rings by the drag links during pivoting of the beam, the beam is connected at its free end to a second arm 30 which is pivotable about an axis 28 by means of a torque tube 26 or other suitable actuator, and the length of the second arm 30 between the axis 28 and its point of connection 44 to the beam is made as nearly as possible equal to the length of the first arms 24. By this means the fore and aft movement of the beam can be matched to the fore and aft movement of the unison rings, or at least in the case of one of them, and the drag links remain substantially in the plane of the unison rings.

5 Claims, 6 Drawing Figures

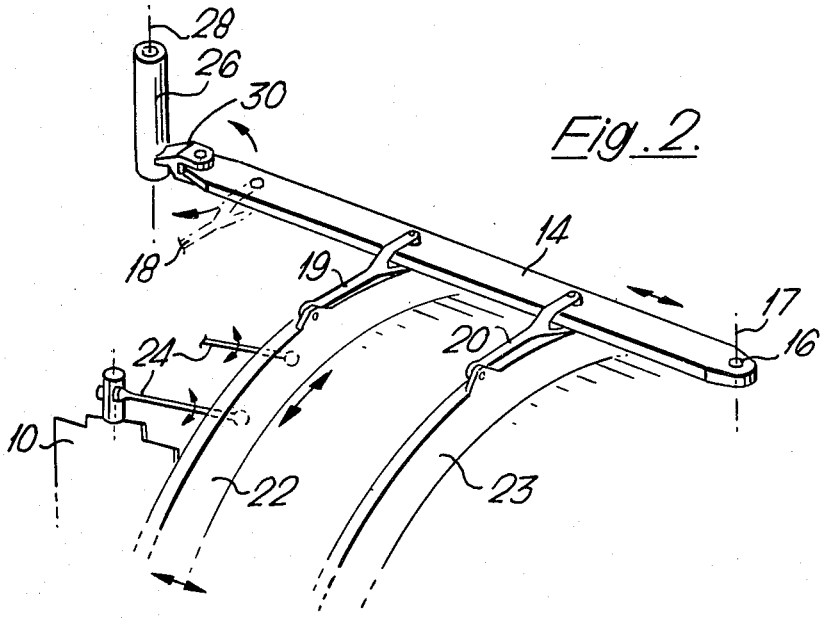
Fig. 2.
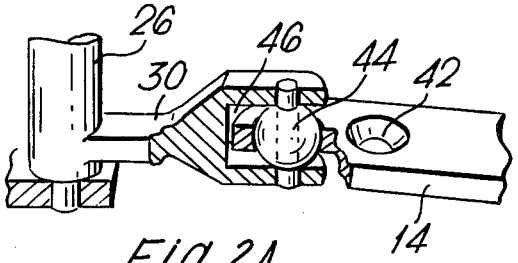
Fig. 2A.
Fig. 3.
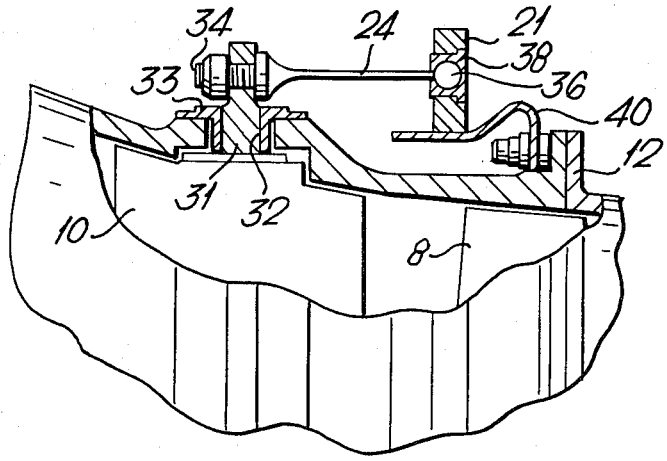

VARIABLE STATOR VANE OPERATING MECHANISM FOR TURBOMACHINES

DESCRIPTION

The present invention relates to a variable stator vane operating mechanism for turbo-machines, by which is meant an operating mechanism for rotating stator vanes about their longitudinal axis to vary their angle of attack. Such mechanisms are generally used in axial flow compressors of gas turbine engines. It is known in such mechanisms to provide a rotatable unison ring which is connected by a plurality of flexible arms (hereinafter referred to as first arms) to each of a plurality of stator vanes. The unison ring is rotated about the engine axis to rotate the arms which rotate the vanes about their own longitudinal axis.

The mechanism for rotating the unison ring is a beam which is pivoted at one end and is swung in a horizontal plane at the other end by means of an actuator.

A drag link connects the beam to the unison ring to rotate the ring as the beam swings. There may, in fact, be several drag links connecting the beam at different points along its length to a plurality of unison rings if more than one row of stator vanes in the compressor is to be of variable angle.

The problems which arise with such mechanisms are that, although it is convenient to have a single actuator for the beam which in turn operates several unison rings, the points of connection of the various parts of the system move in several directions at the same time. For example, the unison ring rotates about the engine axis, and points of contact between the unison ring and the first arms must therefore move around the circumference of the unison ring. At the same time the stator vane pivot is fixed so that the ends of the first arms which contact the unison ring try also to describe a circle in a horizontal plane and centered on the vane axis. To accommodate both of these motions the unison ring is designed to move axially and the first arms are made flexible enough to twist or bend as required.

Similarly the drag links have to follow both the movement of circumference of the unison ring as it rotates and moves axially, and the movement of the beam.

The drag links are usually provided with spherical joints at each end so that they can pivot to follow the motions of the unison ring and the beam. However, the relative axial motions of the beam and unison ring causes axial displacement of the ends of the drag links which causes side loads to be exerted on the unison rings.

For cost and weight saving a single drag link is provided in each case between the beam and a unison ring. Thus the side load is applied to each ring at one circumferential point on the ring, and has to be resisted by any of the first arms on the opposite side of the ring adjacent that one point. Where there are relatively few vanes, for example, in the first vane row, the whole of the side load may be shared only by one or two of the first arms. This requires that the arms be relatively stiff which is in conflict with the requirement to be flexible described above.

In our U.K. Pat. No. 1,511,723 there is disclosed an operating mechanism for variable angle stator vanes in which the beam pivot is itself mounted on a pivoting bracket which allows for limited axial movement of the beam. While this additional movement of the beam alleviates some of the complexity in the mounting of the beam actuator and goes some way towards reducing the compound movements of the drag links connecting the beam to the unison rings, the axial movement of the beam is quite small and the problem of the side loads still exists.

One object of the present invention is to provide a simplified variable stator vane operating mechanism of the kind operated by a pivoting beam as described above, and in which side loads on any one unison ring are substantially eliminated.

In a case in which more than one row of vanes in an axial flow compressor are to be variable, another object of the invention is that the side load on at least one of the unison rings, is substantially eliminated while the side loads on other unison rings are significantly reduced.

According to the present invention a variable stator vane operating mechanism for a turbo-machine comprises a beam, a pivot connection by means of which one end of the beam is connected to static structure of the machine for pivoting movement about a substantially radial axis, means allowing fore and aft movement of the beam along its length, at least one unison ring supported for both rotation about the machine longitudinal axis and for fore and aft movement along the machine axis, a drag link connecting each said unison ring to the beam, a plurality of flexible first arms each of which is pivotably connected to one of the unison rings and is connected to a vane to rotate the vane, and an actuating mechanism for moving the beam, wherein the actuating mechanism comprise means for producing an arcuate movement in the beam to rotate each unison ring and which is such that the fore and aft movement of the point of connection of at least one drag link to the beam substantially matches the fore and aft movement of the unison ring to which the drag link is connected and which is caused by pivoting of the associated first arms connected to the unison ring.

The advantage provided by this actuating mechanism is that where the fore and aft movement of the point of connection of the drag link to the beam exactly matches the fore and aft movement of its associated unison ring there is no pivoting movement of the associated drag link and therefore no side load introduced to the unison ring. By careful design of the whole mechanism it is also possible to minimize the side loads on the remaining unison ring in a multi-stage compressor.

The fore and aft movement of the beam may be achieved by mounting the pivoted end of the beam on a pivotting arm or bracket, as described for example, in our U.K. Pat. No. 1,511,723 or alternatively by mounting the beam for fore and aft sliding movement on its support.

The means for producing said arcuate movements in the beam may comprise a torque tube mounted for rotation about a substantially radial axis and connected by a second arm to a point at or adjacent the other end of the beam, the length of the second arm being substantially equal to the length of said associated first arms. The torque tube may be rotated by any conventional form of jack or motor connected thereto.

Alternatively the beam may be connected at said other end to a link or lever mounted on a pivot to rotate about a substantially radial axis by direct operation of a jack, or motor, the length of the link or lever between said other end of the beam and the pivot being substantially equal to the length of said first arms.

Throughout this specification the word substantially is used with references to certain radial axes, lengths of arms and matching of movements in recognition of the fact that while one object of the invention is to achieve exact matching of the fore and aft movements of the points of connection of the drag links to the beam and the associated unison ring in all cases, this may not be possible. To achieve the nearest match possible in all cases certain compromises may have to be included so that the desired matching lengths of the first arms and the second arms, or pivoting links or levers are not exactly achieved.

In addition certain advantages may be achieved in minimizing distortions in the flexible first arms if the pivoting arms of the beam, or the pivoting arms of the second arms, links or levers are not exactly radial but may be inclined slightly fore or aft of the radial.

The invention will now be more particularly described by way of example only and with reference to the accompanying drawings in which:

FIG. 2 is a diagrammatic illustration of the motions of the various parts of the mechanism.

FIG. 2A shows parts of the free end of the beam in more detail.

FIG. 3 is an enlarged longitudinal section through the upstream part of the compressor of the engine of FIG. 1 showing the parts of the operating mechanism including the actuating mechanism in more detail.

Figure 1:
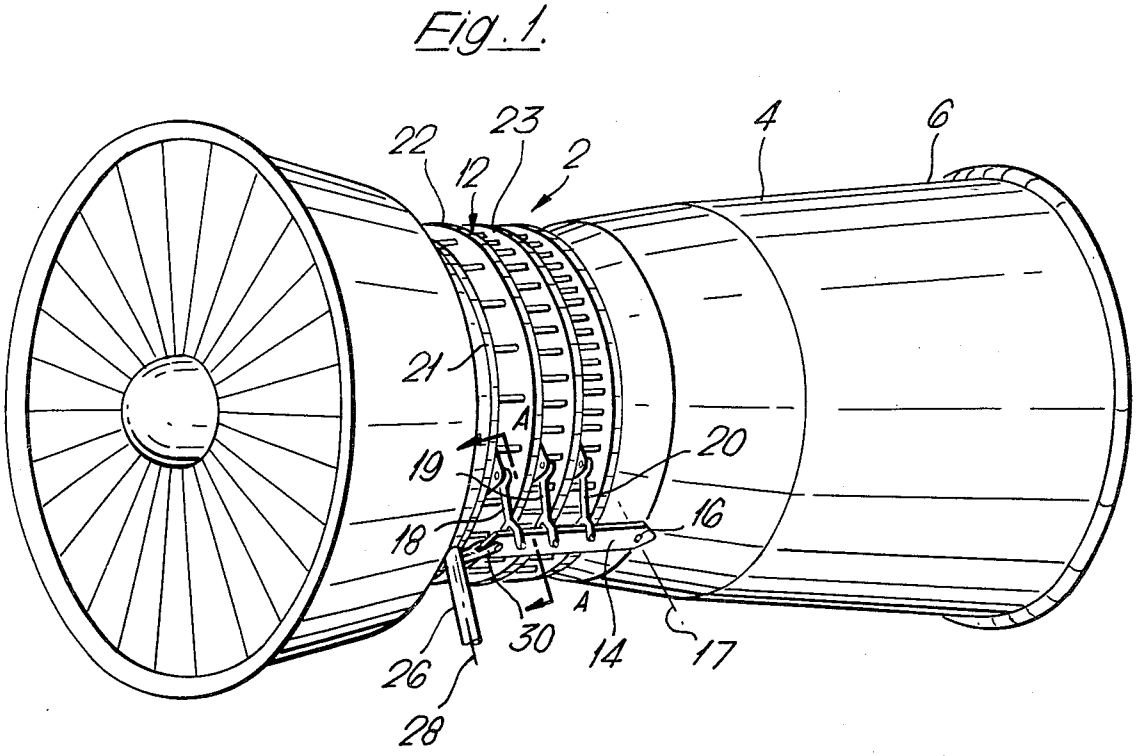
FIG. 1 illustrates a gas turbine engine having a compressor including several rows of variable stator vanes and including a variable stator vane operating mechanism of the present invention.

Referring now to FIG. 1 of the drawings there is shown a gas turbine engine having a compressor section 2, a combustion section 4 and a turbine section 6. The invention is concerned only with the compressor section 2 so that the remainder of the engine is not further described since it may be of any conventional type.

The compressor section comprises alternate rows of rotor blades 8 and stator vanes 10 (FIG. 4) within a casing 12, and the first three rows of stator vanes are rotatable about their longitudinal axis to vary their angles of attack.

In general the operating mechanism for effecting the rotation consists of a beam 14 which extends axially of the compressor and is connected to the engine casing by means of a pivot 16 at its downstream end (downstream that is, in the direction of air flow through the compressor). The connection is such that the beam can swing in a plane tangentially of the casing about a radial axis 17 through said one end and is capable of fore and aft movement along the engine axis. The beam is connected by three drag links 18,19,20 to respective unison rings 21,22 and 23 which are rotatable about the engine axis and are supported for fore and aft movement along the engine axis. The rings in turn are connected to each of the vanes 10 by flexible first arms 24, details of which are shown in FIG. 3. The beam is actuated by a torque tube 26 rotatable about a radial axis 28 by any appropriate jack or motor and connected to the beam at its free end by a second arm 30.

Referring to FIG. 2 of the drawings it can be seen that as the torque tube 26 is rotated the second arm swings in a horizontal plane about axis 28 and moves the upstream end of the beam in an arc of a circle about the axis 28. This causes the beam to swing about its pivot 16 and to move longitudinally in a direction fore and aft of the engine axis.

The swinging motion of the beam imparts movement to the drag links 18,19,20 in directions substantially tangentially of the unision rings 21,22 and 23 to rotate them about the engine axis, and this rotation causes pivoting of the respective first arms about the longitudinal axes of the vanes. Since the first arms are fixed to the vanes, this pivoting of the arms rotates the vanes to vary their angles of attack. The pivoting of the first arms 24 about the fixed longitudinal axes of the vanes causes their free ends to describe an arc of a circle causing fore and aft movement of the unison rings along the engine axis. Since the arms are each connected at one end to a fixed point on a vane and their other ends must follow the rotation of the respective unison ring, they must necessarily be made of a flexible, resilient material.

Greater detail is shown of the interconnection of various parts of the mechanism in FIG. 3 where for clarity the drag links have been removed, and only one of the three variable geometry stages of the compressor is shown.

Each vane 10 has an integral spigot 31 which is supported for rotation in the casing 12 by means of a bearing 32 formed on a removable sleeve 33 for ease of maintenance. A first arm 24 is connected to the spigot 31, and for ease of maintenance the connection is by means of a nut 34 on a threaded end of the arm so that the connection is releasable. The order end of the arm is attached to the unison ring 21 through a universal coupling which consists of a ball 36 on the arm which fits into a socket 38 which fits into one of a plurality of holes in the unison ring.

The unison ring itself is supported for rotation and axial movement on a plurality of pads 40 spaced around the casing and bolted thereto. The unison ring is connected by drag link 18 to the beam 14 at the position indicated by one of the three apertures 42 in the beam (see FIG. 2).

Movement of the free end of the beam by torque tube 26 may be under the manual control of a pilots lever or by automatic control from the engine control system. The second arm 30 is integral with the radially inner end of the torque tube and is connected to the end of the beam by a joint including a ball 44 connected securely to the arm 30, by a bolted joint (not shown) and a socket 46 at the end of the beam which slides on the surface of the ball. The length of the arm 30 is made substantially equal to the length of the arm 24 so that the fore and aft, or longitudinal movement of the beam is equal to the axial movement of the unison ring 21.

It will be understood that exact equality in the lengths of the arms 30 and 24 is only required when the torque tube axis 28 is in the same plane as the pivot axes of the vanes. Otherwise the arm 30 will be slightly longer if the torque tube axis is further from the beam pivot than the vane pivot axes, and slightly shorter if the torque tube axis is closer to the beam pivot. The lengths of the respective arms are optimized taking the effects of other possible variants into consideration.

For example in the particular design shown, the beam is inclined so that its longitudinal axis diverges radially and forwardly from the engine axis in order to clear the tops of the vane spigots. This has a slight effect on the movements of parts of the mechanism. It is also possible to incline the axis 28 of the torque tube either forwardly or rearwardly and use the resulting radial movement of the ball joint 44 to offset radial movements of the connections to the unison ring or to optimize the geometrical relationships or the movements of the various drag links.

Other possible variations may be made to assist in optimizing the geometry of the parts to save space, minimize stresses and operational loads or to gain other advantages, so that the invention is not intended to be limited to the particular configurations shown in the drawings except as defined within the scope of the appended claims.

Figure 4:
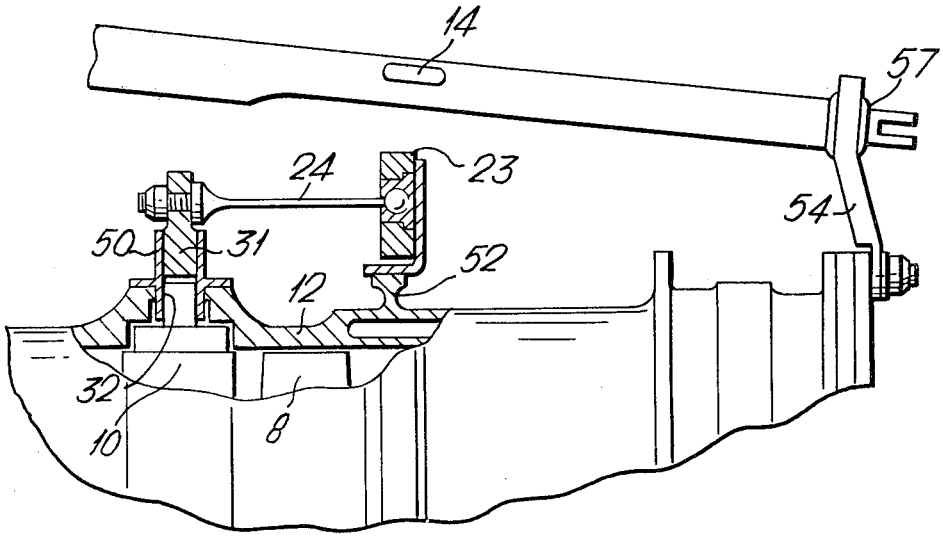
FIG. 4 is an enlarged longitudinal section through the downstream part of the compressor of the engine showing parts of the operating mechanism and the pivoting end of the beam in more detail, and, FIG. 5 is a transverse section of the engine of FIG. 1 on the line AA illustrating the drag link mountings.

In FIG. 4 at the other end of the compressor the third row of rotatable stator vanes is shown along with the mounting of the beam on the casing. The connection between the vanes and the unison ring 23 by first arms 24 is very similar. The main differences are that the vane spigot 31 is provided with a second bearing surface 50 in addition to the bearing 32, and the unison ring is supported for axial movement and rotation on a circumferential flange 52 on the casing 12. In this embodiment, as before, the co-operating bearing surfaces are formed on a removable sleeve for ease of maintenance.

The beam is connected to the casing by a bracket 54 which is bolted to the casing and has a socket for supporting a ball 57 in which the end of the beam is slideably mounted to allow for both pivoting of the beam and the axial sliding movement. In an alternative construction the bracket 54 could be pivotably mounted on the casing for pivoting about a transverse axis tangential to the casing to allow for the fore and aft movement of the beam.

Figure 5:
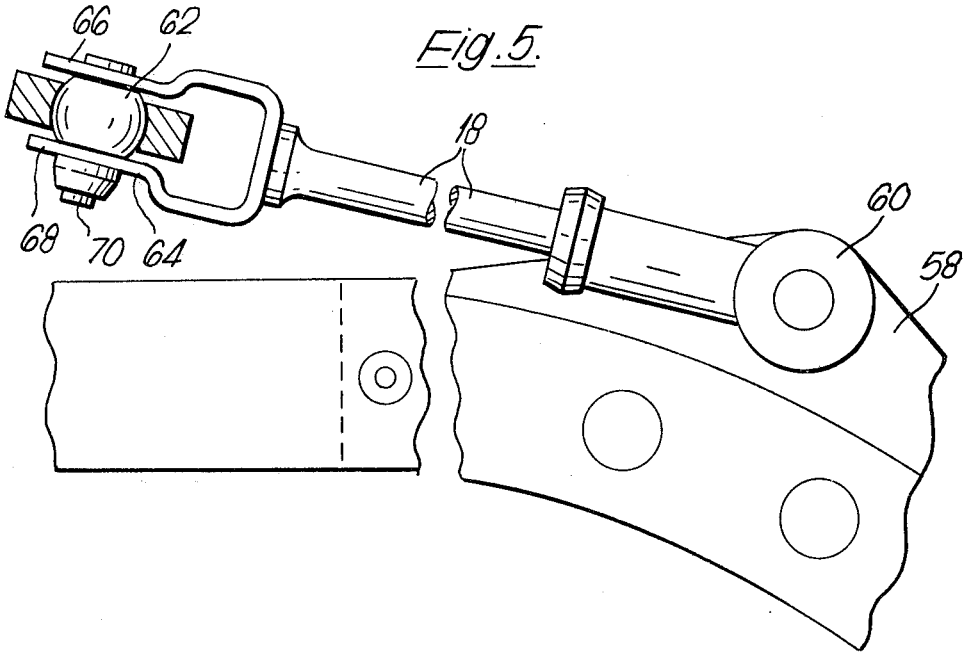

FIG. 5 shows the mounting of a drag link 18 to the beam 14 and to the unison ring 21. A bracket 58 is bolted to the unison ring over a significant circumferential extent in order to spread the operating load. The bracket supports a ball 60 on one end of the drag link 18.

At the other end of the drag link a ball 62 is provided to fit into the aperture 42. The ball is connected to a forked connector 64 having upper and lower arms 66, 68 which fit respectively over and under the beam and receive a bolt 70 which passes through the ball and is held by a nut 72. Thus the drag link is capable of universal pivoting motion at both ends.

In setting up the geometry of the operating mechanism, the position of the inlet guide vane, which is the first variable stage in the compressor described above, and the angle through which it must move determines the position of the torque tube and the position of the connection of the first drag link 18 to the beam. The position of either of the other two vane rows and the angle through which these vanes move determines the length of the beam and the point of the beam pivot on the casing. Since the spacing of the stator vane rows and their angular variation is determined by aerodynamic considerations it may be possible only to completely eliminate side loads in one of the unison rings. In this case the inlet guide vanes would be chosen since there are fewer vanes in the row so that any side load is carried by few of the flexible first arms. Thus the length of the second arm is made equal as far as possible to the lengths of the first arms connecting the guide vanes to the unison ring 21. The angles which the remaining drag links take up relative to the planes of their respective unison rings are then minimized as far as possible by optimizing the remaining geometry, i.e. the positions of the connections of the drag links on the beams.

The preferred actuating mechanism described is the torque tube 26 and the second arm 30. Other constructions may be provided however, which produce the required arcuate movement of the free end of the beam.

For example, the second arm may take the form of a pivoted link or bell crank lever connected to the beam at one end and a jack could be substituted for the torque tube to cause the lever to swing around the pivot to constrain the movement of the free end of the beam to the required arcuate movement. In such an embodiment the length of the link or lever between the pivot and the free end of the beam would be the length which substantially equates to the length of the first arms.

We claim:

1. A variable stator vane operating mechanism for a turbo-machine comprising a beam, a pivot connection by means of which one end of the beam is connected to static structure of the machine, the machine having a longitudinal axis, said pivot connection enabling a pivoting movement of the beam about an axis substantially at right angles to the machine longitudinal axis, means allowing lengthwise movement of the beam, at least one unison ring supported both for rotation about and movement along the machine longitudinal axis, each unison ring being connected to the beam by a drag link which extends between the ring and the beam, a plurality of flexible first arms each of which is pivotably connected to a unison ring and to a vane to rotate the vane, and an actuating mechanism for moving the beam, said actuating mechanism comprising means for producing both said pivoting and lengthwise movements of the beam to rotate the unison rings, said actuating mechanism being so dimensioned and arranged that the longitudinal movement of the beam produced thereby is substantially matched to the movement of at least one unison ring along the machine longitudinal axis which is caused by pivoting of the associated first arms connected to the unison ring.

2. A variable stator vane operating mechanism according to claim 1 and in which the means for producing the pivoting and lengthwise movements of the beam comprises a second arm mounted for pivoting motion on a generally radial axis and connected to the beam adjacent the end thereof which is opposite said one end and means for causing pivoting motion of the second arm about said radial axis, the length of the second arm between said pivot axis and the point of connection to the beam being substantially equal to the length of the first arms connecting at least one of the unison rings to its corresponding vanes.

3. A variable stator vane operating mechanism according to claim 2 comprising a torque tube mounted for rotation about said generally radial axis and being connected to the second arm to rotate it about said radial axis, and means for rotating the torque tube.

4. A variable stator vane operating mechanism according to claim 1 and in which the means for allowing lengthwise movement of the beam comprises a support means on which the pivoted end of the beam is capable of sliding in a lengthwise direction.

5. A variable stator vane operating mechanism according to claim 1 and in which the means for allowing lengthwise movement of the beam comprises a support bracket which is mounted for lengthwise pivoting movement, and to which the pivoted end of the beam is connected.

* * * * *